US005095727A

United States Patent [19]

Westerman et al.

[11] Patent Number: 5,095,727

[45] Date of Patent: Mar. 17, 1992

[54] ROLLER BURNISHING TOOL FOR EFFECTING DIMINISHING STRESS REVERSAL ON ANNULAR WORKPIECES

[75] Inventors: William J. Westerman, Columbia; Michael C. Burr, Lugoff; Farin L. Derrick, Columbia, all of S.C.

[73] Assignee: Cogsdill Tool Products, Inc., Camden, S.C.

[21] Appl. No.: 469,777

[22] Filed: Jan. 19, 1990

[51] Int. Cl.[5] ..... B21D 39/10

[52] U.S. Cl. ..... 72/122; 72/125; 72/126

[58] Field of Search ..... 72/122, 125, 126

[56] References Cited

U.S. PATENT DOCUMENTS

| | | | |
|---|---|---|---|
| 2,620,689 | 12/1952 | Cogsdill . | |
| 2,716,360 | 8/1955 | Cogsdill et al. . | |
| 2,895,356 | 7/1959 | Cogsdill . | |
| 2,929,278 | 3/1960 | Muldoon . | |
| 3,087,359 | 4/1963 | Cogsdill . | |
| 3,122,947 | 3/1964 | Cogsdill . | |
| 3,166,958 | 1/1965 | Cogsdill . | |
| 3,172,309 | 3/1965 | Cogsdill . | |
| 3,298,256 | 1/1967 | Cogsdill . | |
| 3,306,136 | 2/1967 | Gustkey . | |
| 3,320,652 | 5/1967 | Huber et al. . | |
| 3,449,984 | 6/1969 | Cogsdill . | |
| 3,498,245 | 3/1970 | Hansson | 72/126 |
| 3,626,560 | 12/1971 | Kalen . | |
| 3,820,210 | 6/1974 | Kalen . | |
| 3,930,294 | 1/1976 | Kalen . | |

FOREIGN PATENT DOCUMENTS

| | | | |
|---|---|---|---|
| 202930 | 12/1982 | Japan | 72/125 |

OTHER PUBLICATIONS

"Chipless Finishing"; Cogsdill Tool Products, Inc., 21 pages.

"Shefcut 'G' Type Burnishing Reamer"; Cogsdill Tool Products, Inc., 14 pages, catalog 600.

"Product Information and Literature Request Form"; Cogsdill Tool Products, Inc., Brochure 834-3.

"Mirror Master"; Cogsdill Tool Products, Inc., Flyer #848.

"Roll-a-Finish Bearingizing CX Machine"; Cogsdill Tool Products, Inc., 25 pages, Catalog 500-3.

"Burraway Burr-Off Micro-Limit"; Cogsdill Tool Products, Inc., 9 pages, Catalog 100h.

*Primary Examiner*—Lowell A. Larson

*Attorney, Agent, or Firm*—Harness, Dickey & Pierce

[57] ABSTRACT

A roller burnishing tool is disclosed having inner and outer pluralities of concentrically disposed, precision tapered rolls. A precision tapered annular mandrel is disposed within the inner plurality of rolls and operates to controllably urge the inner plurality of rolls outwardly against a lip of a workpiece inserted between the inner and outer pluralities of rolls. The inner plurality of rolls forces the lip outwardly into contact with the outer rolls, and the pressurized contact of the rolls effects a burnishing action on the surfaces of the lip of the workpiece. In a preferred embodiment, the burnishing tool also includes a pilot stop for receiving an alignment post used to align the workpiece with the burnishing tool. When the burnishing tool engages the alignment post, the pilot assembly and mandrel are forced inwardly, whereby the tapered mandrel causes the inner rolls to be forced outwardly against an inner surface of the workpiece, thereby forcing the portion of the workpiece being machined outwardly against the outer rolls. The pressurized contact of the rolls effects a burnishing action which helps provide a micro surface finish to the surfaces of the workpiece. In a preferred embodiment of the invention, each inner roll is also spaced approximately midway between its nearest adjacent outer rolls to thereby effect a stress reversal of the workpiece and remove any curl from the workpiece.

16 Claims, 3 Drawing Sheets

ROLLER BURNISHING TOOL FOR EFFECTING DIMINISHING STRESS REVERSAL ON ANNULAR WORKPIECES

BACKGROUND OF THE INVENTION

1. Technical Field

This invention relates to machine finishing tools for performing chipless finishing processes and, more particularly, to a roller burnishing tool for burnishing simultaneously the inner and outer surfaces of an annular metal workpiece and effecting a stress reversal of the material of such a workpiece.

2. Discussion

Chipless finishing tools are used in a wide variety of machine tool applications and processes to cold work metal surfaces to produce a very uniform, dense, low micro surface finish. A principal advantage of chipless finishing is the ability to produce such finishes without removing metal chips from the workpiece, which would otherwise occur in most other finishing processes such as reaming, boring and grinding.

One particular chipless finishing process is generally known as roller burnishing. In roller burnishing, metal is cold worked under a high force. The high force is designed to exceed the yield strength of the metal being finished, thereby causing a plastic deformation of its surface material. The deformation causes the peaks on the surface being finished to flow into valleys on the surface, thereby effecting an extremely smooth surface.

Roller burnishing tools generally are available for finishing a wide variety of surfaces including the outer diameter of cylinders and inner diameters of circular holes. With an inner diameter burnishing tool the high force needed for causing the necessary surface deformation is generated by a number of independent, tapered "rolls" housed within a "cage". Disposed within the cage is an inversely tapered mandrel which bears upon the rolls and, when rotated, causes the rolls to rotate and thereby apply a high, steady, rolling pressure against the inner surface of the workpiece. With an outer diameter roller burnishing tool, the mandrel circumscribes the rollers and forces them inwardly against an outer surface of a workpiece inserted within the rollers. As the mandrel rotates it causes the rollers to rotate and apply a steady rolling pressure against the outer surface of the work surface.

A particularly useful process performed by rollers is "stress reversal" of the material of a workpiece. Typically this is effected by feeding a piece of material through a plurality of parallel rollers. The rollers are further arranged so that the material moving between them is overbent in successively diminishing amounts, thereby removing, for example, the "curl" in a section of formerly coiled sheet metal.

Although stress reversal tools such as was just described above operate well in a flat plane, it would be advantageous if such a stress reversal operation could be performed on an annular workpiece. Performing a stress reversal operation on a distorted annular workpiece would help to remove the deformation and cause a more nearly perfect cylindrical surface to be formed.

It is therefore a principal object of the present invention to provide a roller burnishing tool operable to roller burnish simultaneously the inner and outer surfaces of an annular workpiece.

It is a further object of the present invention to provide a roller burnishing tool operable to enable successive cycles of diminishing stress reversal to be effected upon an annular workpiece.

It is still a further object of the present invention to provide a burnishing tool capable of performing, simultaneously, burnishing and stress reversal operations on an annular workpiece.

It is another object of the present invention to provide a roller burnishing tool operable to remove distortions and to cause a thin workpiece to become more nearly cylindrical.

SUMMARY OF THE INVENTION

The above and other objects are accomplished by a roller burnishing tool in accordance with the present invention. The roller burnishing tool generally comprises an inner plurality of precision tapered rolls arranged in a generally circular arrangement; an outer plurality of precision tapered rolls also arranged in a generally circular arrangement concentric with the first plurality of rolls; and a precision, inversely tapered mandrel concentrically disposed within the inner plurality of rolls. The outer rolls are of a diameter which is slightly larger than the diameter of the inner plurality of rolls, to thereby create an annular area between the inner and outer pluralities of rolls into which an annular workpiece may be inserted. To effect a stress reversal, each inner roll is spaced approximately midway between its nearest adjacent outer rolls. By utilizing this spacing arrangement, the "curl" may be taken out of annular materials formed from sheet metal.

The mandrel is disposed concentrically within the inner plurality of rolls and operates to slidably effect contact between the inner rolls and the inner surface of a workpiece inserted between the inner and outer rolls as it is rotated axially. As the mandrel is slidably urged inwardly relative to the tool, its taper forces the inner rolls outwardly into contact with the inner surface of the portion of the workpiece being machined. The portion being machined is then forced outwardly into contact with the outer rolls. When the mandrel is rotated axially, the inner and outer pluralities of rolls roll over the inner and outer surfaces of the workpiece, thereby effecting a burnishing action on the surfaces and a stress reversal of the material between the inner and outer pluralities of rolls.

In a preferred embodiment of the invention, a pilot assembly is included for helping to align the inner and outer rolls concentrically with the portion of the workpiece to be machined.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
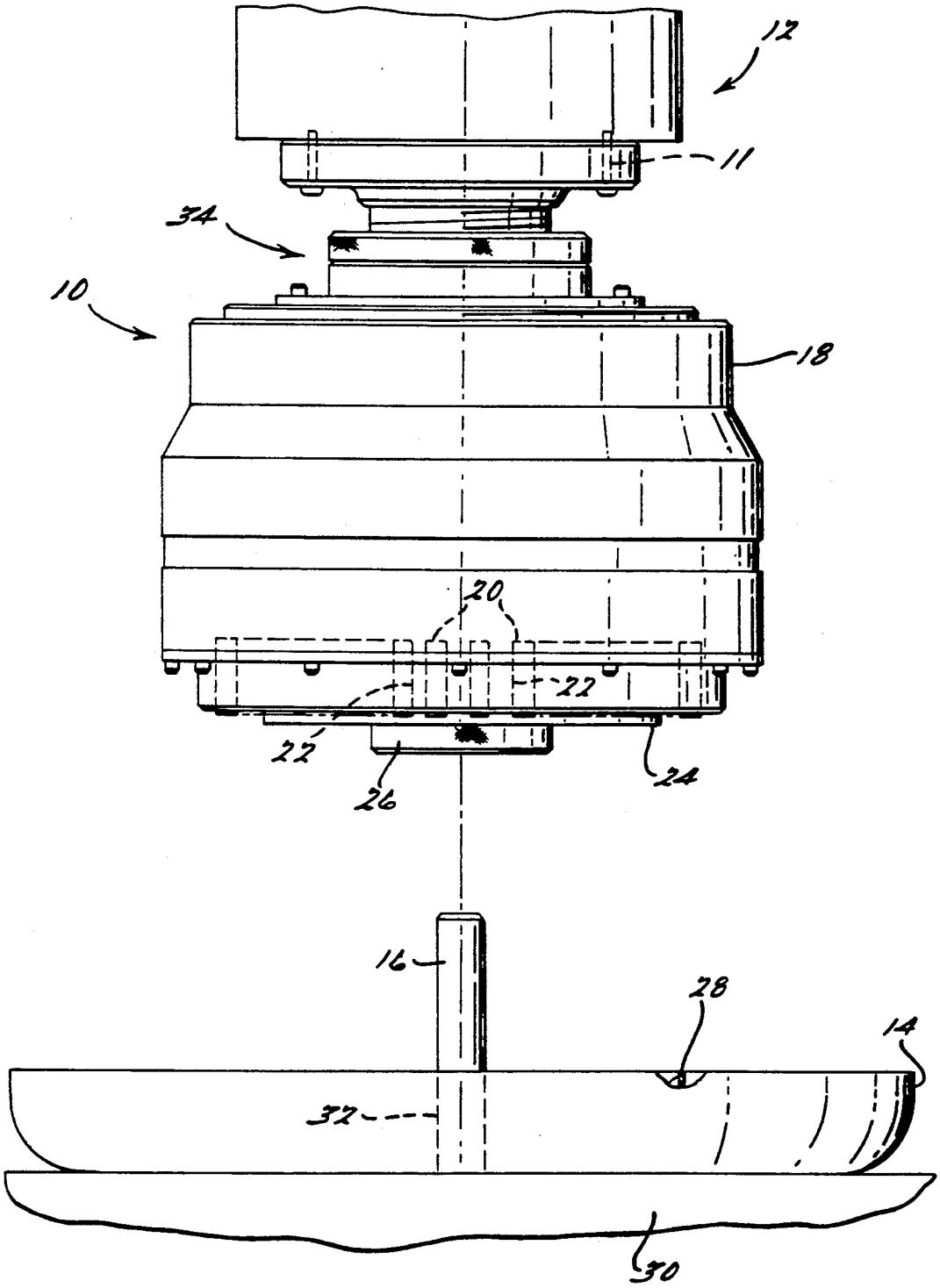
FIG. 1 is an elevational side view of the burnishing tool in accordance with the present invention in a raised, fully extended position ready to be lowered onto a workpiece to be machined.

In FIG. 1 a burnishing tool 10 in accordance with the present invention is shown coupled via screws 11 to a chuck 12 of a machine press (not shown), a workpiece 14 and an elongated alignment post 16. The tool 10 generally comprises an annular outer housing 18; an outer plurality of highly polished, hardened, and precision tapered rolls 20 arranged in a generally circular fashion concentrically within the outer housing 18; an inner plurality of highly polished, hardened and precision tapered rolls 22 also arranged in a generally circular fashion concentrically within the outer rolls 20; and a hardened, annular, precision tapered mandrel 24 disposed concentrically within the inner rolls 22. A pilot stop 26 is also included and is disposed concentrically within the housing 18. The workpiece 14 is in the form of a portion of a torque converter housing for an automatic transmission torque converter. The workpiece 14 includes an annular lip portion 28 which is machined by the tool 10. The alignment post 16 is attached to a base portion 30 upon which the workpiece 14 rests, and extends upwardly through a center hub section 32 of the workpiece 14 to help center the tool 10 concentrically with the workpiece 14 when the tool 10 is lowered. It should be appreciated that although a portion of the torque converter housing has been illustrated as the workpiece, a wide variety of annular objects could just as well be substituted for the torque converter housing and be easily machined by the present invention.

For imparting rotational movement to the tool 10, the chuck 12 is coupled to a drill press-like machine (not shown) and also to a drive flange 34. It should be appreciated, however, that other means could be used for imparting rotational movement to the tool 10, such as a lathe.

Figure 2:
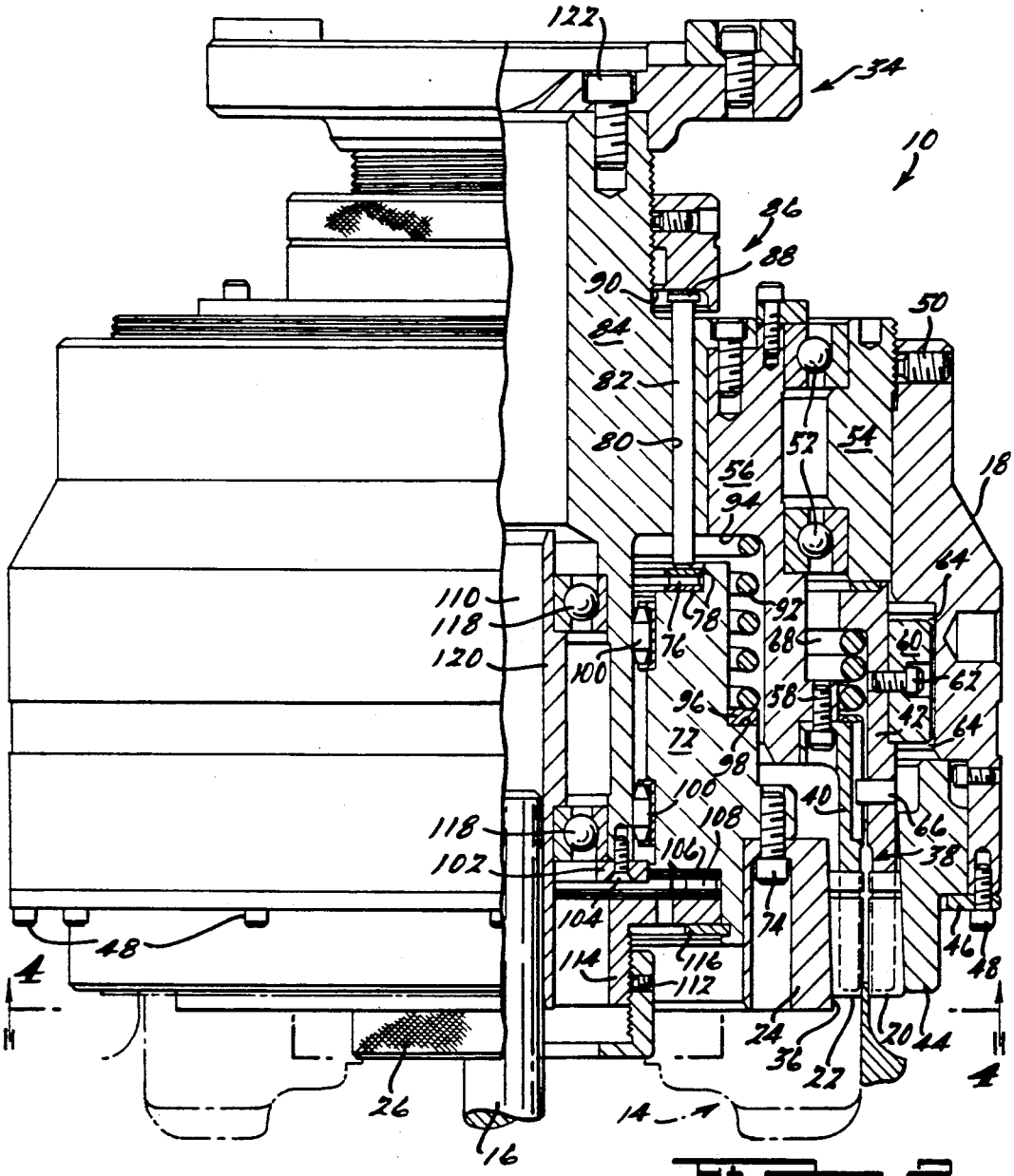
FIG. 2 is an elevational side view in partial cross-section of the burnishing tool in accordance with the present invention showing the tool in a fully collapsed position.
Figure 4:
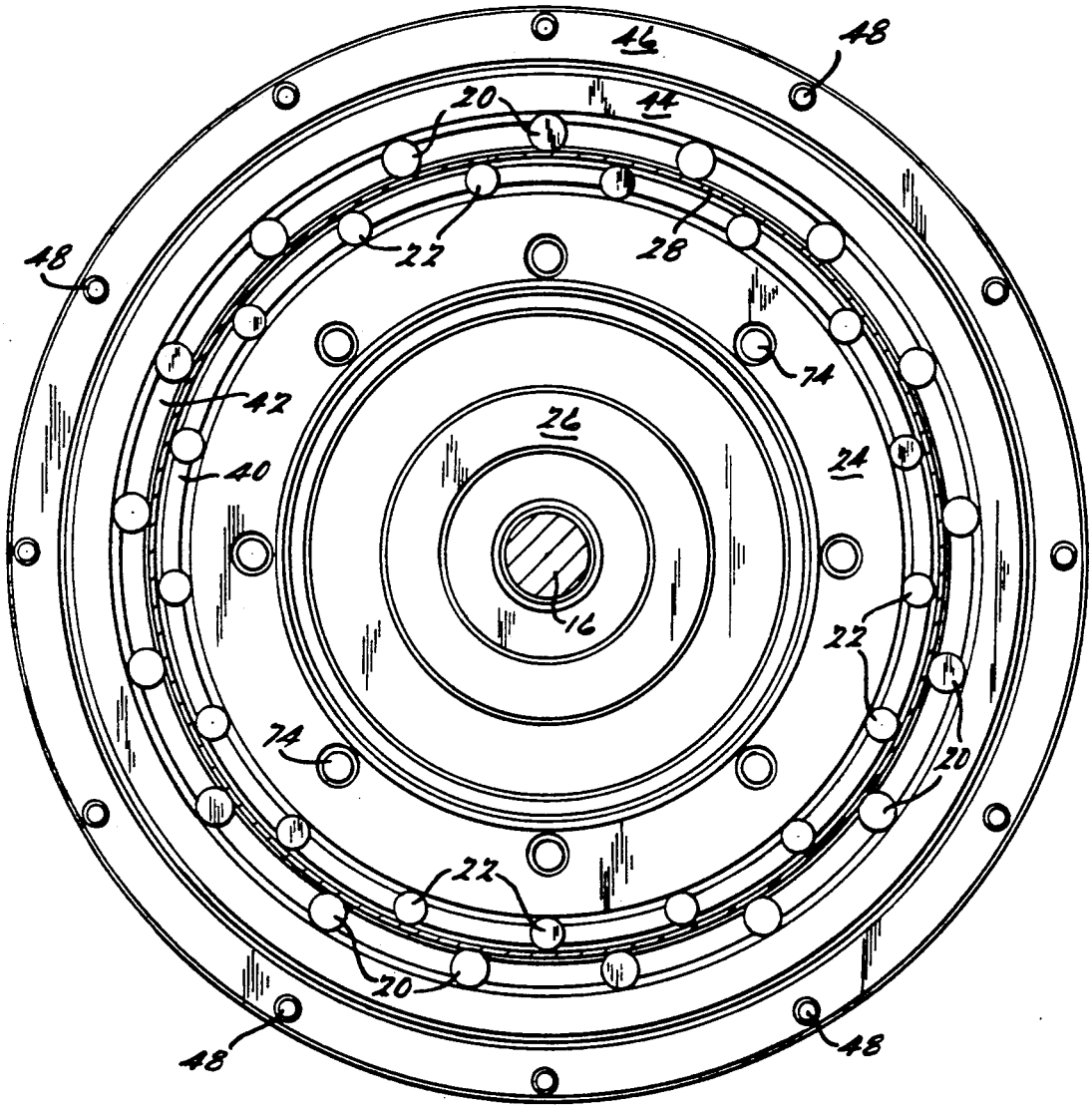
FIG. 4 is a plan view of the end of the burnishing tool taken along section lines 4—4 of FIG. 2 showing more clearly the configuration of the inner and outer rolls.

Referring now to FIG. 2, a detailed illustration of the internal components of the burnishing tool 10 of the present invention is shown. The tool 10 has been illustrated in FIG. 2 in a "collapsed" position, which will be discussed further in connection with the operation of the tool 10. As can be seen more clearly, the inner and outer rolls 22 and 20 each include a taper of preferably about 3 to 4 degrees. The mandrel also includes a surface 36 which is tapered inversely to the taper of the inner rolls 22. The degree of taper is preferably about 3 to 4 degrees, although it may vary in accordance with the needs of specific applications. Both the rolls 20 and 22 and mandrel 24 have a hardness in the range of preferably about 60 to 62 on a Rockwell C scale. Both the inner and outer rolls 22 and 20 are housed within a single cage assembly 38 having inner and outer cage members 40 and 42 respectively, and are operable to move axially and independently about their longitudinal axes. The rolls 20 and 22 are further arranged in a staggered fashion such that each inner roll 22 is approximately midway between its nearest adjacent outer rolls 20. This feature of the present invention can be seen more clearly in FIG. 4.

Further included in the tool 10 is a hardened race 44, which is precision tapered inversely to the taper of the outer rolls 20, and which is adapted to slidably engage the outer rolls 20. The race 44 itself also has a thickness of preferably about 60 to 62 on the Rockwell C scale. The race 44 is coupled to the outer housing 18 of the tool 10 via a race retainer 46 and socket head screws 48. The degree of taper of race 44 is preferably equal to the degree of taper of the mandrel 24. The outer housing 18 and race 44 can be slidably moved slightly relative to the outer roll 20 by loosening set screws 50 (of which only one is visible in FIG. 2) and rotating housing 18 which is threadably attached to the bearing retainer 54. The sliding action of the outer housing 18 and race 44 coupled thereto enables the inward/outward travel of the outer rolls 20 to be controlled.

To enable axially rotational movement of the outer housing 18 and race 44 relative to the outer rolls 20, ball bearings 52 are provided. The bearings 52 enable the race 44 to rotate axially in response to axially rotational movement of the outer rolls 20. Helping to maintain the bearings 52 in place is a bearing retainer 54, which itself is threadably attached to housing 18 and locked in relative to the outer housing 18 by screws 50 (of which only one is shown in FIG. 2).

The cage assembly 38 is attached to drive flange 34 through shank 84 and cage adapter 56. Cage assembly 38 is therefore caused to rotate by machine chuck 12 causing rolls 20 and 22 to rotate against race 44 and mandrel 24 respectively. The cage retainer 60 in turn is provided with some longitudinal play, as indicated by areas 64, which allows for a small amount of longitudinal travel of the outer housing 18 when the housing 18 is adjusted. The outer cage member 42 is also coupled to the inner cage member 40 via a pin 66 which forces the outer cage member 42 to rotate axially in cooperation with the inner cage member 40. To maintain the outer cage member 42 in the correct axial position within the outer housing 18 a first spring 68 is included.

With further reference to FIG. 2, the mandrel 24 is removably secured to a mandrel adapter 72 via screws 74 (only one of which can be seen in FIG. 1) thereby enabling the mandrel 24 to be replaced after prolonged use causes unacceptable wear of its tapered surface 36. The mandrel adapter 72 is operable to slidably engage a thrust bearing 76, which in turn engages a thrust race 78. The thrust race 78, in turn, engages a pin 80 which extends through a bore 82 in shank portion 84 of the tool 10 to an adjuster 86. The adjuster 86 is operable to limit the longitudinal travel of the pin 80, mandrel adapter 72 and mandrel 24 by causing abutting contact between a head portion 88 of the pin 80 and an internal shoulder portion 90 of the adjuster 86. A second spring 92 is interposed between a shoulder portion 94 of the cage adapter 56 and an oppositely facing thrust race 96 and shoulder portion 98 of the mandrel adapter 72. The second spring 92 exerts an outward biasing force to enable the mandrel adapter 72 and mandrel 24 to be held in an outwardly extended position relative to the cage adapter 56 when the tool 10 is not engaging a workpiece. The outwardly extended mandrel 24 enables the inner rolls 22 to retract inwardly, thereby increasing the area between the inner and outer rolls 22 and 20 to help facilitate insertion of lip 28 of the workpiece 14 prior to a machining cycle.

To facilitate the rotational and sliding action of the mandrel adapter 72 relative to shank 84, needle bearings 100 have also been included. The needle bearings 100 enable a small amount of longitudinal travel by the mandrel adapter 72 as it and the mandrel 24 move longitudinally inwardly or outwardly. To limit the outwardly sliding action of the mandrel adapter 72 and mandrel 24, a retainer 102 is included which is secured to an end of the shank 84 via retaining screws 104 (of which only one is visible in FIG. 2). A thrust race 106 and thrust bearing 108 are also included for helping to receive the thrust of the pilot stop 26 workpiece 14 during a machining cycle.

As discussed briefly in connection with FIG. 1, the pilot stop is adapted to receive the alignment post 16 and allow the post to pass therethrough into a center pilot bore 110. The pilot stop 26 is secured via a set screw 112 to a stop adapter 114. A retaining ring 116 secures the stop adapter 114 and helps force the stop adapter 114 against the thrust race 106 of thrust bearing 108 when the pilot stop 26 contacts the workpiece 14.

Further included in the tool 10 are ball bearings 118 and a pilot 120. When the drive flange 34 is coupled to the shank 84 via screws 122, the bearings 118 allow the shank 84 to be rotated axially relative to the pilot 120.

Figure 3:
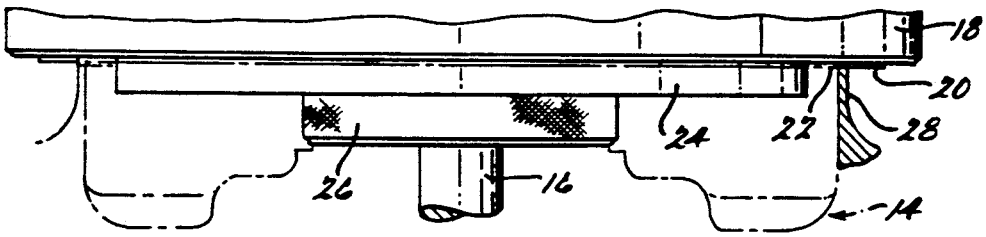
FIG. 3 is an elevational side view of a portion of the burnishing tool showing the pilot stop at its initial point of contact with the workpiece.

The sequence of operation of the tool 10 can best be understood by reference to FIGS. 1-3. Initially, the tool 10 is in a raised, or elevated, position, preferably about six to eight inches above the workpiece 14, as illustrated in FIG. 1. As the chuck 12 rotates it causes the drive flange 34 and shank 84 of the tool 10 to rotate. The shank 84, in turn, causes the cage adapter 56 and cage assembly 38 to all rotate cooperatively in a planetary fashion about the pilot 120. The actual speed at which the tool 10 may be rotated may vary considerably, although the speed is preferably kept in the range of about 45 to 135 rpm. As the tool 10 is fed towards the workpiece 14 in a relatively rapid movement, the pilot 120 receives the alignment post 16 therein and centers the tool concentrically with hub 32 of the workpiece 14. As the tool 10 continues to feed towards the workpiece 14 the pilot stop 26 comes into abutting contact with a portion of the workpiece 14, as illustrated in FIG. 3. The contact between the pilot stop 26 and the workpiece 14 causes the downward movement of the pilot stop 26, mandrel adaptor 72 and mandrel 24 to stop while the shank 84, cage adapter 56, cage assembly 38, rolls 20 and 22, outer housing 18 and race 44 all continue to feed downwardly, at a preferably slightly slower speed than the initial downward travel, towards the workpiece 14. Although the rates at which the shank 84 is fed towards the workpiece 14 may also vary widely, they are preferably within the range of about 0.010 to 0.210 inches per revolution.

After the pilot stop 26 comes into abutting contact with the workpiece 14, the continued downward travel of the shank 84 forces the mandrel 24 longitudinally inwardly relative to the cage adapter 56. The mandrel 24, in turn, forces the mandrel adaptor 72 inwardly against the biasing force of spring 92 until the head 88 of retaining pin 80 is forced against shoulder portion 90 within adjuster 86, as shown in FIG. 2. As the mandrel 24 is forced inwardly, its tapered surface 36 causes the inner rolls 22 to be forced outwardly against the inner surface of the lip 28 of the workpiece 14. As the inner rolls 22 are forced against the inner surface of lip 28, they force the lip 28 outwardly into contact with the outer rolls 20, as also shown in FIG. 2, thereby causing the outer rolls 20 to rotate axially. It should be appreciated, however, that the tool 10 could be easily modified by those of ordinary skill in the art such that the race 44 is operable to slidably force the outer rolls 20 inwardly while the inner rolls 22 are restricted in their longitudinal movement.

The axial rotation of the outer rolls 20 causes the race 44 and the outer housing 18 to rotate. As the inner and outer surfaces of the lip 28 are squeezed between the rollers 20 and 22, the extremely high pressure imparted by the rollers 20 and 22 effects a burnishing action on the surfaces of the lip 28. The burnishing action causes the peaks on the surfaces to flow into the valleys, thereby providing a uniform, dense, low micro surface finish in the range of about 10 to 60 micro inches. The burnishing action produced by the pressurized contact with the rolls 20 and 22 produces surfaces that have superior wear characteristics, permits economical closer running fits between mating parts, and in other applications could eliminate the need for using bushings, plain bearings and housings. The staggered arrangement of the inner and outer rolls 22 and 20 also effects a stress reversal on the lip 28 of the workpiece 14 by overbending it as the rolls 22 and 20 traverse its circumference. This helps the lip 28 to become more nearly cylindrical in shape and improves its concentricity.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An apparatus for deforming metal surfaces, comprising:

a first plurality of roller means disposed in a generally circular arrangement having a first diameter;

a second plurality of roller means disposed in a generally circular arrangement concentric with said first plurality of roller means, said generally circular arrangement of said second plurality of rollers having a second diameter, said second diameter being slightly larger than said first diameter to thereby allow a metallic material having inner and outer surfaces to be inserted therebetween; and axially rotatable mandrel means for controllably urging at least one of said first and second pluralities of roller means towards the other, whereby said first and second pluralities of roller means are caused to be disposed in pressurized contact with said inner and outer surfaces respectively of said metallic material when said metallic material is inserted between said pluralities of roller means and said axially rotatable mandrel means is rotated axially.

2. An apparatus for deforming metal surfaces, comprising:

a first plurality of roller means disposed in a generally circular arrangement having a first diameter;

a second plurality of roller means disposed in a generally circular arrangement concentric with said first plurality of roller means, said generally circular arrangement of said second plurality of rollers having a second diameter, said second diameter being slightly larger than said first diameter to thereby allow a metallic material having inner and outer surfaces to be inserted therebetween;

means for controllably urging at least one of said first and second pluralities of roller means towards the other to thereby cause said first and second pluralities of roller means to forcibly contact said inner and outer surfaces respectively of said metallic material when said metallic material is inserted between said pluralities of roller means; and means for axially rotating at least one of said first and second pluralities of roller means whereby said pluralities of roller means operate to controllably deform said surfaces of said metallic material while in contact with said surfaces.

3. The apparatus of claim 2, wherein said first and second pluralities of roller means each comprise a plurality of elongated, hardened, precision tapered rolls.

4. The apparatus of claim 2, wherein each roller means of said first plurality of roller means is disposed midway between adjacent roller means of said second plurality of roller means.

5. The apparatus of claim 2, wherein said means for controllably enabling said first and second pluralities of roller means to forcibly contact said inner and outer surfaces respectively of said metallic material comprises a generally annular, spring biased mandrel operable to slidably urge said first plurality of roller means into contact with said inner surface of said metallic material and to forcibly urge said metallic material outwardly to thereby force said outer surface of said metallic material into contact with said second plurality of roller means.

6. The apparatus of claim 2, wherein said means for enabling axial rotation of said first and second pluralities of roller means comprises means for causing a simultaneous, planetary rotation of said first and second pluralities of roller means about a common axis.

7. An apparatus for deforming simultaneously inner and outer surfaces of an annular metallic workpiece, said apparatus comprising:

an inner plurality of roller means disposed in a generally circular arrangement having a first diameter;

an outer plurality of roller means disposed in a generally circular arrangement concentric with said inner plurality of roller means and having a second diameter, said second diameter being slightly larger than said first diameter to thereby allow a portion of said workpiece to be inserted therebetween;

means for simultaneously rotating said inner and outer pluralities of roller means in a planetary fashion about a common axis; and mandrel means for controllably urging said inner roller means outwardly against a portion of said inner surface when said workpiece is inserted between said inner and outer roller means, thereby urging said portion of said workpiece outwardly, whereby said outer surface of said workpiece is forcibly urged into contact with said outer roller means, said inner and outer roller means operating simultaneously to deform said inner and outer surfaces of said portion of said workpiece.

8. The apparatus of claim 7, wherein each said roller means of said inner plurality of roller means is disposed approximately midway between its nearest adjacent outer roller means.

9. The apparatus of claim 7, wherein said inner and outer pluralities of roller means each comprise a plurality of elongated, hardened, precision tapered rolls.

10. The apparatus of claim 7, whrein said mandrel means comprises an annular, spring biased, precision tapered mandrel concentrically disposed within said inner roller means and operable to slidably urge said inner roller means outwardly in a controlled fashion.

11. The apparatus of claim 7, further comprising a cage operable to house said inner and outer roller means, said cage further being operable to allow independent, axially rotational movement of said inner and outer roller means.

12. The apparatus of claim 7, wherein said apparatus further comprises means for centering said apparatus concentrically with said portion of said workpiece to be deformed.

13. The apparatus of claim 12, wherein said means for centering said apparatus comprises a spring biased pilot assembly, said pilot assembly including a pilot hole operable to engage with an alignment post holding said workpiece in a centered position.

14. The apparatus of claim 7, further comprising a slidable annular outer housing operable to slidably move said outer plurality of roller means controllably inwardly or outwardly.

15. An apparatus for simultaneously deforming inner and outer surfaces of an annular metallic workpiece, said apparatus comprising:

an inner plurality of rolls disposed in a generally circular arrangement, said circular arrangement having a first diameter;

an outer plurality of rolls disposed in a generally circular arrangement concentric with said inner plurality of rolls, said outer plurality of rolls further having a second diameter, said second diameter being slightly larger than said first diameter to thereby allow a portion of said annular metallic workpiece to be inserted therebetween;

a cage for housing said inner and outer pluralities of rolls, said cage being operable to allow independent, axially rotational movement of said inner and outer pluralities of rolls;

an outer housing for housing said cage;

a pilot assembly for enabling said inner and outer pluralities of rolls to be concentrically aligned with said annular metallic workpiece; and a mandrel for controllably urging said inner rolls outwardly against a portion of said inner surface when said annular metallic workpiece is inserted between said inner and outer rolls, thereby urging said portion of said annular metallic workpiece outwardly, whereby said outer surface of said annular metallic workpiece is forcibly urged into contact with said outer rolls, said inner and outer rolls operating simultaneously and cooperatively to deform said inner and outer surfaces of said portion of said annular metallic workpiece.

16. The apparatus of claim 15, further comprising:

a mandrel adapter coupled to said mandrel, said mandrel adapter having a shoulder portion;

a cage adapter having a shoulder portion;

a spring interposed between said shoulder portions of said cage adapter and said mandrel adapter, said spring being operable to provide a biasing force to force said mandrel adapter outwardly relative to said cage adapter;

a shank having a bore therethrough; and a retaining pin slidably disposed within said bore of said shank, said retaining pin being operable to limit the inward travel of said mandrel adapter and said mandrel relative to said cage adapter.

* * * * *